United States Patent [19]

Munn

[11] 4,109,799

[45] Aug. 29, 1978

[54] SKYLINE LOGGING CARRIAGE

[76] Inventor: Leo Arnold Munn, P.O. Box 636, Granite Falls, Wash. 98252

[21] Appl. No.: 602,380

[22] Filed: Aug. 6, 1975

[51] Int. Cl.[2] ..... B66C 21/00

[52] U.S. Cl. ..... 212/83; 212/98; 212/122; 254/139

[58] Field of Search ..... 212/76, 83–84, 212/89, 96, 127, 71, 87, 122, 97–98; 254/139, 153, 185 R, 188

[56] References Cited

U.S. PATENT DOCUMENTS

| | | | |
|---|---|---|---|
| 876,874 | 1/1908 | Hausfelder | 212/89 |
| 3,022,747 | 2/1962 | McIntyre | 212/87 X |
| 3,369,673 | 2/1968 | Mosher | 212/71 |
| 3,499,544 | 3/1970 | Kolpe | 212/76 |
| 3,556,484 | 1/1971 | Moller et al. | 212/84 |
| 3,776,390 | 12/1973 | Junes et al. | 212/89 |

FOREIGN PATENT DOCUMENTS

| | | | |
|---|---|---|---|
| 690,857 | 7/1964 | Canada | 212/71 |
| 1,341,708 | 9/1963 | France | 212/87 |

*Primary Examiner*—Drayton E. Hoffman
*Assistant Examiner*—R. B. Johnson
*Attorney, Agent, or Firm*—Seed, Berry, Vernon & Baynham

[57] ABSTRACT

A skyline logging carriage wherein the winch drum around which the load line is wound is powered by a fluid motor through a worm gear arrangement which eliminates the need for a separate braking system. The fluid motor is driven by a fluid pump powered by a diesel engine mounted on the carriage frame. The hydraulic transmission of power to the winch drum eliminates the need for clutches or direct mechanical connection and braking systems generally required. Greater freedom in placement of the winch drum in relation to the fairlead to obtain an optimum fleet angle and distance between the winch drum and fairlead for proper level winding of the load line about the winch drum is made possible by hydraulic transmission of power to the winch drum. Operation of the winch line is radio controlled by an operator at a yarder or other location. The carriage is moved along the skyline by a main line or main line and haulback lines.

2 Claims, 6 Drawing Figures

FIG. 1
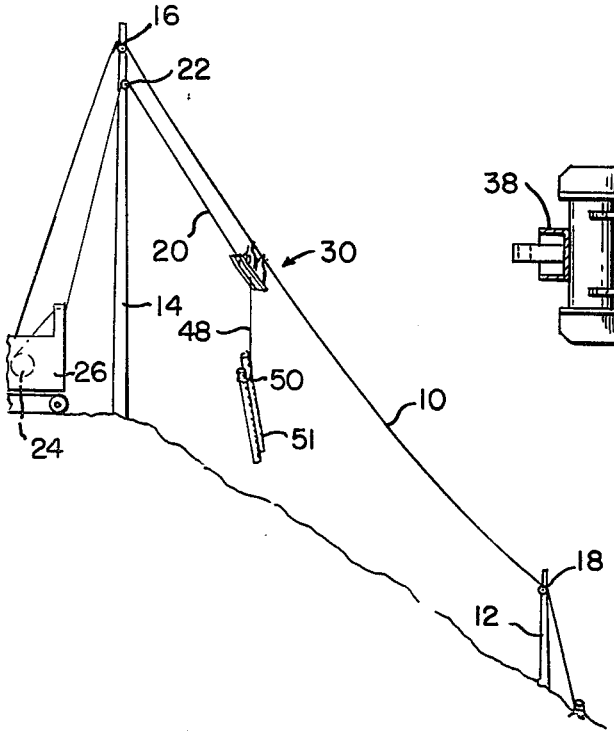
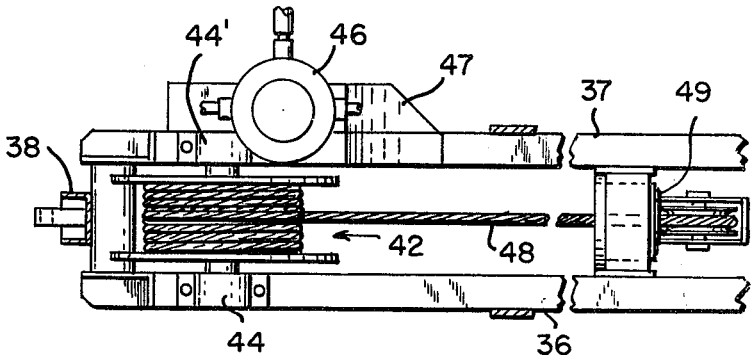
FIG. 3
FIG. 2
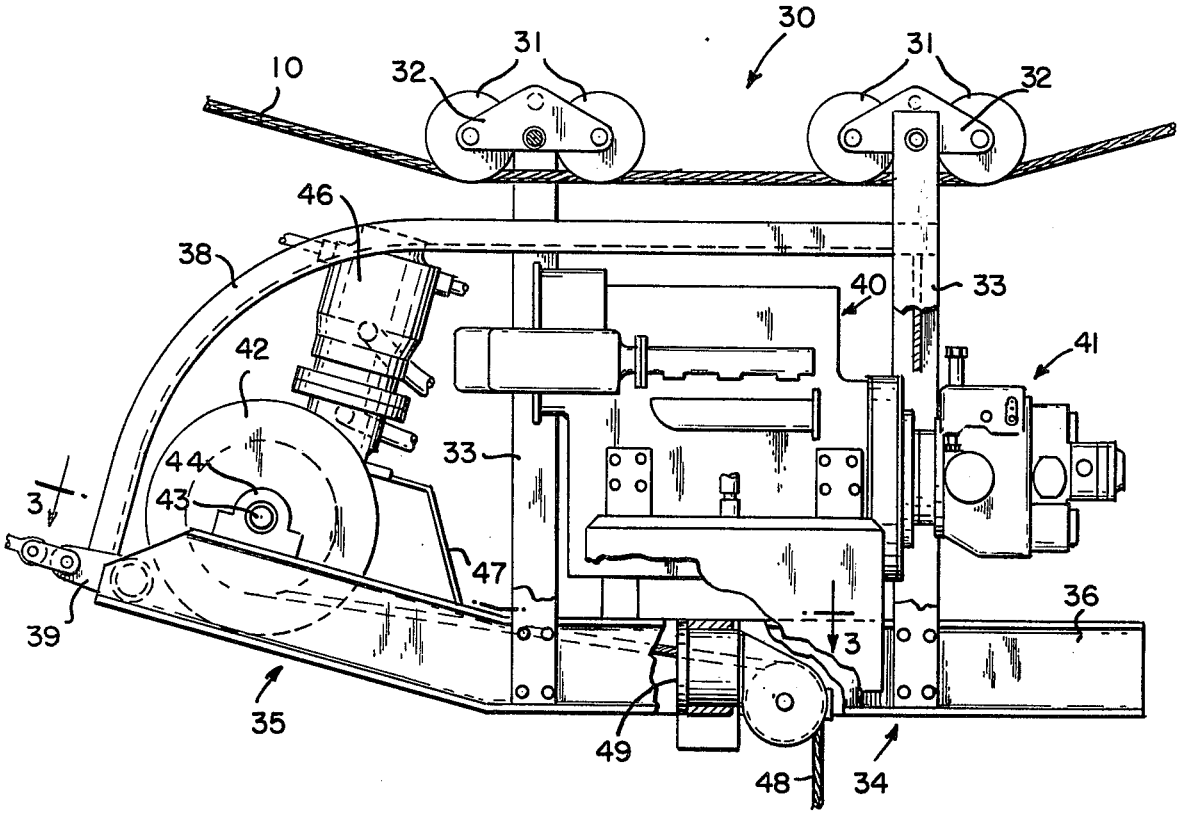

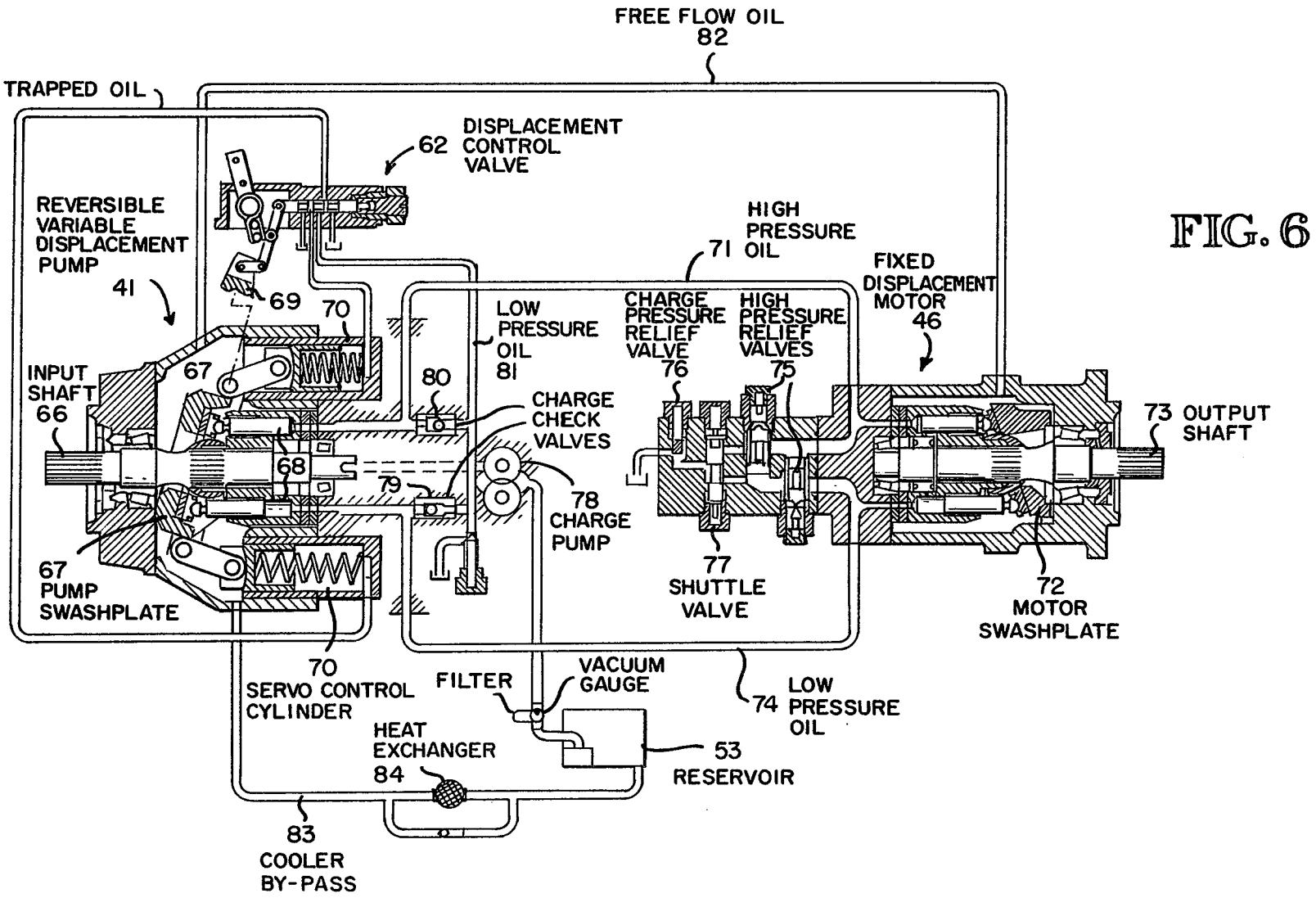
FIG. 6
73 OUTPUT SHAFT
72 MOTOR SWASHPLATE
FIXED DISPLACEMENT MOTOR 46
HIGH PRESSURE OIL 71
HIGH PRESSURE RELIEF VALVES 75
CHARGE PRESSURE RELIEF VALVE 76
77 SHUTTLE VALVE
LOW PRESSURE OIL 74
53 RESERVOIR
FREE FLOW OIL 82
DISPLACEMENT CONTROL VALVE
62
LOW PRESSURE OIL 81
CHARGE CHECK VALVES
78 CHARGE PUMP
VACUUM GAUGE
FILTER
HEAT EXCHANGER 84
80
79
70
69
68
67
SERVO CONTROL CYLINDER
83 COOLER BY-PASS
TRAPPED OIL
REVERSIBLE VARIABLE DISPLACEMENT PUMP 41
INPUT SHAFT 66
67 PUMP SWASHPLATE

SKYLINE LOGGING CARRIAGE

BACKGROUND OF THE INVENTION

1. Field of the Invention

This invention relates to a skyline logging carriage for yarding logs in a logging operation.

2. Prior Art Relating to the Disclosure

Aerial cable logging systems utilizing skyline carriages are used for logging operations in the Pacific Northwest area of the United States. Skyline carriages generally include a winch drum which may be powered by a diesel engine mounted on the frame of the carriage. The engine drives the winch drum through a clutch or direct mechanical connection. U.S. Pat. No. 3,083,839, for example, employs a centrifugal clutch to transmit power between the engine and the winch drum, effective only at accelerated speeds of the engine. U.S. Pat. No. 3,022,747 employs disc clutches, with the driving members of the clutches directly powered through a gear case by the engine. Skyline carriages, such as those disclosed in the above patents, pose severe maintenance problems. Additionally, such mechanical drives limit the location of the winch drum on the carriage frame. This presents problems of locating the fairlead in relation to the winch drum to obtain proper level winding of the cable about the winch drum.

SUMMARY OF THE INVENTION

It is a primary object of this invention to provide a skyline logging carriage wherein the winch drum mounted on the carriage is powered by hydraulic transmission of power from an internal combustion engine mounted on the frame of the carriage.

It is a further object of this invention to provide a skyline logging carriage allowing flexibility in locating the winch drum around which the load line is wound relative to the fairlead for proper level winding of the cable about the drum.

It is a further object of this invention to provide a skyline logging carriage wherein the portion of the frame of the carriage mounting the winch drum is designed to prevent the carriage from lifting off the skyline when a heavy load is being hauled in.

It is a further object of this invention to provide a skyline carriage requiring no separate braking system for the winch drum.

These and other objects are accomplished by a skyline logging carriage wherein the winch drum of the carriage around which a load line is wound is powered by a fluid motor through gear means, the fluid motor driven by a fluid pump powered by an engine mounted on the carriage frame. The gear means includes a worm drive which effectively brakes the winch drum should a power failure occur. The carriage is moved along the skyline by a main line or main and haulback lines, as may be desired. Braking means engaging the skyline for braking the skyline carriage may be included. Operation of the winch line and the skyline braking means is preferably by radio control. The winch drum is located relative to the fairlead to obtain proper level winding of the cable about the winch drum. The carriage is designed to prevent lifting of the carriage off the skyline when lifting heavy loads from the ground.

BRIEF DESCRIPTION OF THE DRAWINGS

FIG. 1 is a perspective view of the skyline carriage described herein in use in a downhill logging operation;

FIG. 2 is a side elevation of the skyline logging carriage of FIG. 1;

FIG. 3 is a cross-section along section line 3—3 of FIG. 2 illustrating the relative positions of the winch drum and fairlead;

FIG. 6 is a schematic of the fluid pump and motor used to power the winch drum.

DESCRIPTION OF THE PREFERRED EMBODIMENT

Figure 4:
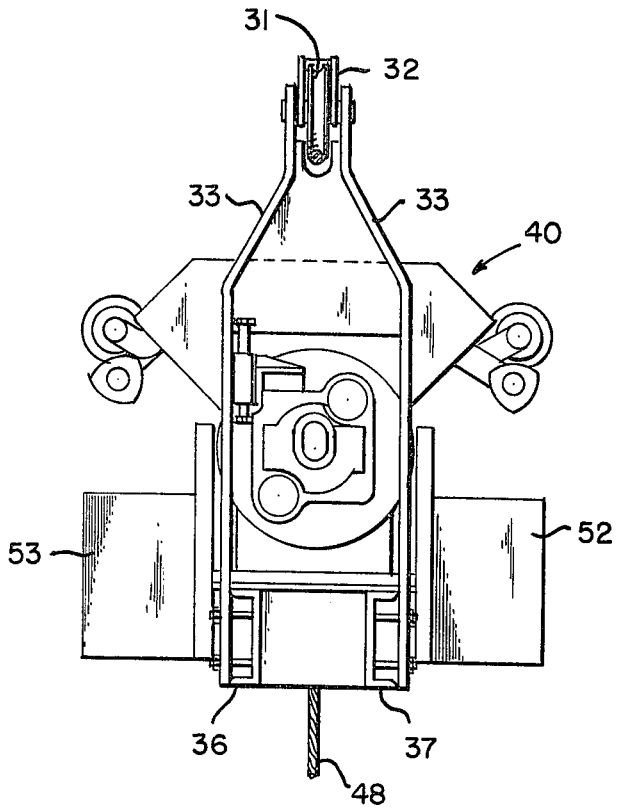
FIG. 4 is an end view of the skyline logging carriage of FIG. 2.

The skyline logging carriage described herein is useful for downhill logging operations, although it is not restricted thereto. Referring to FIG. 1, skyline 10 is anchored at its uphill and downhill ends to stumps. The skyline is a wire-strand rope supported between its anchored ends by spars 12 and 14. The skyline is sufficiently taut to hold it above the ground at all points. The skyline extends over sheaves 16 and 18 at the upper ends of each of the spars 12, 14 and from there descends to the ground, where it is anchored to a stump or other suitable anchor.

The skyline carriage 30 is supported on the skyline 10 and is controlled in its travel along the skyline by a main line cable 20 extending from the skyline logging carriage over the sheave of a pulley block 22, the main line cable then wound around a cable-winding drum 24 of a yarder 26. The yarder, through the cable-winding drum, pulls the carriage to the uphill end of the skyline and also controls the downhill travel of the skyline carriage.

Referring to FIG. 2, the skyline logging carriage 30 is supported for travel on the skyline 10 by tandem pairs of rider sheaves 31. Each pair of sheaves is mounted for rotation between spaced side plates 32 to form respective sheave assemblies. The sheave assemblies are each then pivotally mounted to the upper ends of vertical carriage supports 33.

The skyline logging carriage frame comprises an engine support section 34 which extends substantially parallel to that portion of the skyline between the tandem pairs of sheave assemblies and a winch drum support section 35 secured to the engine support section 34 at an angle relative to the plane of the engine support section. The purpose for the inclination of section 35 of the base frame will be explained later. Both of the frame sections 34 and 35 consist of spaced apart, parallel extending I-beam members 36 and 37. Vertical carriage supports 33 are secured at their lower ends to the portion of I-beams 36 and 37 making up the engine support section. The carriage supports extend upwardly parallel to each other for a distance sufficient to clear the engine and are then directed inwardly, as illustrated in FIG. 4, to form supports for the sheave assemblies supporting the skyline carriage for travel on skyline 10. A stabilizing beam 38 is secured at one end to the upper portion of the respective vertical carriage supports 33 and at the other end to the terminating end of the inclined winch support section 35 of the base frame. A swivel attachment 39 is provided at the terminating end of the inclined portion of the winch support section 35, as illustrated in FIG. 1, for securing the main line to the logging carriage. If desired, an additional swivel attachment may be included on the opposite end of the carriage for securing a haulback line thereto.

Mounted on the skyline frame over the engine support section 34 of the base frame is a diesel engine 40 of conventional type. The particular engine used is a Deutz air-cooled diesel engine, although other commercially available diesel engines may also be used. The engine is mounted so that its drive shaft extends horizontally and parallel to that portion of the skyline engaged by the carriage. The drive shaft connects directly with and drives the input shaft of a reversible, variable displacement pump 41, the operation of which will be described in further detail with reference to FIG. 6.

A winch drum 42 is rotatably supported on a cross-shaft 43 which is supported at its opposite ends in bearings 44–44' mounted on the respective I-beam portions 36 and 37 of the base section 35. A gear wheel (not shown) covered by housing 45 is coaxially secured to the winch drum 42 (see FIG. 3).

The high-pressure fluid output of the variable displacement pump 41 drives a fixed displacement fluid motor 46 secured to the I-beam 37 of base section 35 by a suitable mounting bracket 47. The output shaft of the motor drives a worm gear (not shown) which meshes with the gear coaxially secured to the winding drum.

The winch drum 42 can be driven selectively in either direction to pay out or wind in a cable or load line 48. The cable extends from the winch drum 42 between the spaced I-beams 36 and 37 and passes through a self-aligning deck-mounted fairlead 49, located intermediate the vertical carriage supports 33. The distance between the winch drum and the fairlead and the angle of the winch drum relative to the fairlead are chosen to assure proper level winding of the cable about the winch drum. Referring to the skyline logging carriage shown in FIG. 2, the overall length of section 34 of the carriage is 69½ inches. The length of section 35 is 44½ inches and is tilted at an angle relative to section 34 of approximately 15°. The combination of the angle at which the winch drum is mounted relative to the fairlead and the distance of the fairlead from the winch drum assures proper level winding of the cable about the winch drum.

Driving the winch drum 42 by hydraulic transmission of power allows maximum flexibility in location of the winch drum relative to the fairlead so that the fairlead can be located at a point on the carriage frame which will assure the greatest stability of the carriage frame on the skyline 10 when lifting heavy loads.

The load line 48 is equipped at its lower end with a hook for connection thereto of one or more choker lines 50 which are connected to logs 51 (see FIG. 1).

The which drum 42 requires no separate braking system due to the worm gear arrangement for driving the winch drum. The worm gear effectively brakes the winch drum 42 and prevents paying out of the load line under loaded conditions. This is a decided advantage and simplifies maintenance of the logging carriage. The carriage also requires fewer handling operations as compared to those systems employing a separate braking system to hold the winch drum against rotation. For those systems, the brake band holding the cable drum must be released before the cable can be driven to haul in or pay out the load line, and then the brake must again be reapplied to set the winch drum.

Figure 5:
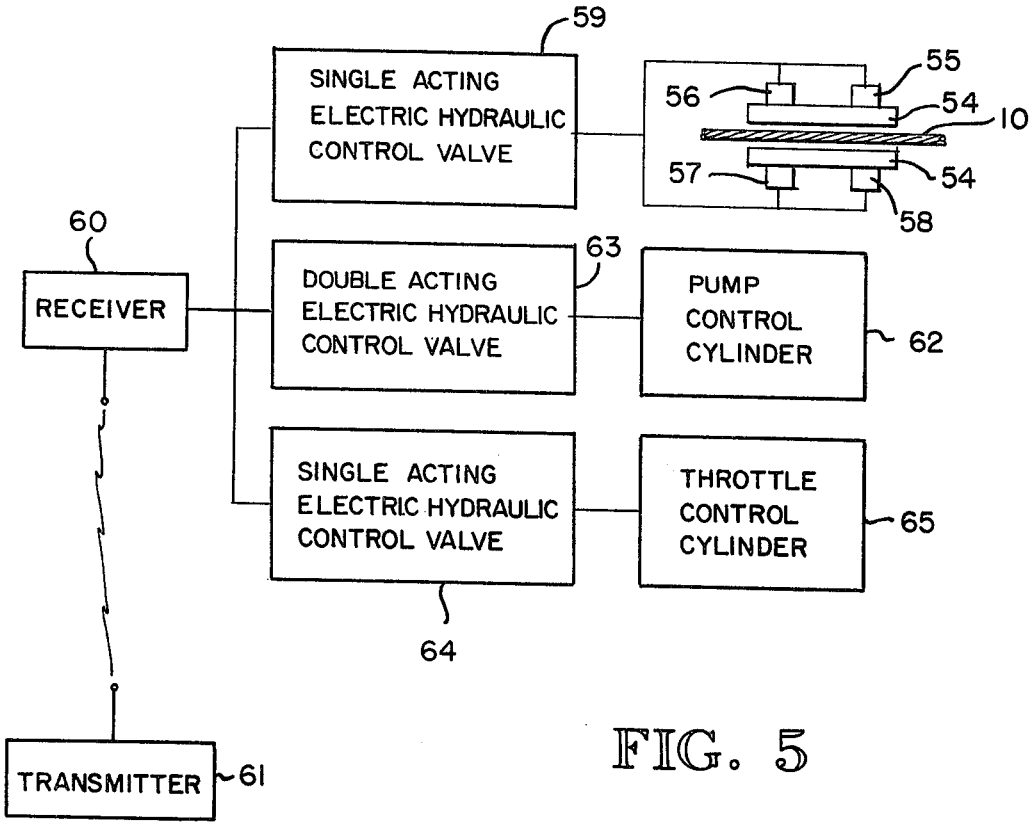
FIG. 5 is a schematic of the control mechanism controlling operation of the winch drum and skyline cable-engaging clamp.

Referring to FIG. 4, fuel for the engine 40 is stored in a fuel storage tank 52 secured to beam 37. On the opposite side of the storage tank 52 is a hydraulic tank 53 holding the hydraulic fluid for the fluid pump 41 and motor 46. A series of control valves (see FIG. 5) actuated by a radio receiver control operation of the winch drum and application and release of a skyline-engaging clamp, should such be desired. A schematic of the control system is illustrated in FIG. 5. The radio control represents no part of this invention and utilizes commercially available equipment.

Referring to FIG. 5, the skyline logging carriage may include a skyline clamp for engaging the skyline cable 10. The particular skyline clamp used does not form a part of this invention and may be one of the several commercially available skyline cable clamps marketed. The skyline clamp is shown schematically and comprises a pair of movable clamp jaws 55 secured on the carriage frame adjacent the skyline cable 10. Clamping pressure is applied to the movable clamp jaws by a plurality of hydraulic cylinder and piston units 55, 56, 57 and 58. Engagement and retraction of the clamping jaws are controlled by a single-acting electric-hydraulic control valve 59. The valve 59 is activated by a radio receiver unit 60 operatively connected thereto on receipt of the receiver unit by a suitable signal from transmitter unit 61.

Operation of the winch drum is controlled by a two-way, self-centering, pump control cylinder and piston unit 62 operatively connected to a double-acting electric-hydraulic valve 63. Receiver unit 60, on receipt of a signal from transmitter unit 61, signals the electric-hydraulic valve 63 and unit 62 to either haul in or pay out the load line 48.

A third single-acting electric-hydraulic valve 64 controls a self-return, throttle control cylinder 65 operatively connected to the throttle of the diesel engine 40.

FIG. 6 illustrates the fluid motor/fluid pump combination powering the winch drum 42. The fluid, fixed displacement motor 46 and the reversible, variable displacement pump 41 are commercially available units. The pump illustrated is a Sunstrand pump, Series 2G, while the fluid motor illustrated is a Sunstrand motor, Series 27. Other fluid pumps and motors may be employed. The variable displacement pump 41 is a rotary pump of the positive displacement type and is designated in the trade as a "swashplate" pump. The input shaft 66 of the variable displacement pump rotates the swashplate 67. The swashplate 67, carrying plungers 68, connects each plunger flow periodically to the suction port on the plunger's suction stroke and to the discharge port on its discharge stroke. The capacity of the pump can be varied by varying the eccentricity of the pump swashplate. This is done through the two-way, self-centering pump control cylinder valve 62. The valve is connected by a linkage 69 to the swashplate 67. Servo control cylinders 69 operate and control the eccentricity of the swashplate 67.

The high-pressure fluid exits from the fluid displacement pump 41 through conduit 71, which is connected to the fluid input of the fixed displacement motor 46. The motor 46 is a fixed displacement, rotary motor. The swashplate 72 is fixed rather than variable. The high-pressure oil drives the output shaft 73 of the motor. The output shaft is connected to the worm gear, which drives the gear coaxially secured to the winch drum 42.

Low-pressure oil is returned to pump 41 through conduit 74. Reference numerals 75, 76 and 77 designate, respectively, high pressure relief valves, a charge pressure relief valve and a shuttle valve.

A charge pump 78 operatively connected to the input shaft 66 of pump 41 charges the system with oil from reservoir 53 through charge check valves 79 and 80. The charge pump 78 also supplies low-pressure oil to control valve 62 through conduit 81. Free-flow oil from motor 46 is channeled through conduit 82 to pump 41 and from there through conduit 83 through a heat exchanger 84 to reservoir 53.

Referring to FIG. 1, the skyling logging carriage is mounted to travel on the skyline cable 10 in the manner disclosed. The operator controlling the carriage 30 causes the carriage to be moved along the skyline 10 to the desired location for picking up a load of logs by hauling in or paying out on the main line wound about the winch drum 24 of the yarder unit 26. The engine of the skyline carriage is maintained at idling speed. Once the desired location above the logs to be transported is reached, the yarder drum 24 is braked, and the operator, through the radio transmitter 61, activates control valve 63 and control cylinder 62 to lower the load line 48 to the ground for connecting to the logs. After connecting the load line to the logs, the operator, through the radio transmitter, again activates the winch drum 42 through control valve 63 in a reverse direction to drive the winch drum 42 to wind in the cable to pull in and lift the logs for suspended travel to the unloading point. Once the logs are suspended from the ground, the winch line drive is stopped and the carriage moved along the skyline 10 by main line 20 to a desired landing area. During travel of the skyline carriage along the skyline, the winch drum 42 of the carriage is effectively braked by the worm gear-gear combination. When the logs reach the desired landing area, the winch drum 42 of the carriage is again activated to lower the logs to the ground for unloading.

The embodiments of the invention in which a particular property or privilege is claimed are defined as follows:

1. A skyline logging carriage adapted to travel along a suspended skyline cable in a logging operation comprising:

a suspended skyline cable, a pair of spaced, vertical carriage yoke supports, each having skyline cable rider sheaves rotatably mounted on one end thereof for flexible suspension of the yoke supports from the skyline cable, the cable extending between the skyline rider sheaves, a carriage frame secured to the other end of the pair of yoke supports, the carriage frame including a first frame portion extending parallel to the portion of the skyline between the skyline cable rider sheaves and a second angled frame portion tilted upwardly toward the skyline cable at an angle of about 15° relative to the first portion, a fairlead mounted on the first portion of the carriage frame intermediate the skyline cable rider sheaves and in the plane formed by the first frame portion, a cable-winding drum rotatably mounted on the angled frame portion of the carriage to provide proper level winding around the winding drum and to prevent lifting of the skyline carriage from the skyline cable when a heavy load is being lifted, the axis of the cable-winding drum elevated above the fairlead and laterally offset therefrom, a load cable extending vertically through the fair-lead and leading onto the cable-winding drum at a materially different angle from the vertical or horizontal, an internal combustion engine having a power output shaft, the engine mounted on the first frame portion directly above the fairlead and adjacent the cable-winding drum, a reversible, variable displacement fluid pump providing a source of high-pressure fluid output connected to the output shaft of the engine, a fluid motor having a worm gear output shaft, the motor driven by the high-pressure fluid output of the variable displacement pump, a circular gear operatively connected to the cable-winding drum and engaging the worm gear, means for controlling travel of the skyline carriage along the skyline including a yarder having a cable-winding drum, and a mainline cable secured at one end to the angled frame portion and wound around the cable-winding drum of the yarder at the other end, control means, including a hydraulic system with radio controlled solenoid valves on the carriage frame, for starting and stopping rotation of the winch drum, either to payout or haul in on the load cable, a brake system mounted on the carriage frame adjacent the skyline cable adapted to grip the skyline cable, and remote controlled means for operating the brake system.

2. The carriage of claim 1 wherein the control means includes a radio transmitter for sending signals, a radio receiver mounted in the carriage for receiving signals from the radio transmitter, and electrically controlled valves responsive to the receiver controlling operation of the winch drum.

* * * * *